United States Patent [19]

Hoffman

[11] Patent Number: 4,697,056

[45] Date of Patent: Sep. 29, 1987

[54] MULTIPOSITION MICROWAVE SWITCH WITH EXTENDED OPERATIONAL FREQUENCY RANGE

[75] Inventor: Jerzy Hoffman, Los Angeles, Calif.

[73] Assignee: Dynatech/U-Z, Inc., Venice, Calif.

[21] Appl. No.: 798,715

[22] Filed: Nov. 15, 1985

Related U.S. Application Data

[63] Continuation of Ser. No. 636,865, Aug. 2, 1984, abandoned.

[51] Int. Cl.[4] ..... H01P 1/12

[52] U.S. Cl. ..... 200/153 S; 200/305; 333/105; 335/5

[58] Field of Search ..... 200/153 S, 304, 305; 333/104, 105, 107, 127, 128, 262; 307/91; 335/5

[56] References Cited

U.S. PATENT DOCUMENTS

| | | | |
|---|---|---|---|
| 3,088,081 | 4/1963 | Cancelman | 200/153 S |
| 3,182,270 | 5/1965 | Horton | 333/105 |
| 3,940,584 | 2/1976 | Cauldwell et al. | 200/153 S |
| 4,187,416 | 2/1980 | Caro | 200/153 S |
| 4,298,847 | 11/1981 | Hoffman | 200/153 S X |
| 4,496,806 | 1/1985 | Maenishi et al. | 200/16 R |

*Primary Examiner*—Stephen Marcus
*Assistant Examiner*—Ernest G. Cusick
*Attorney, Agent, or Firm*—Hamilton, Brook, Smith & Reynolds

[57] ABSTRACT

A multiposition microwave switch with a cavity comprising a center and a plurality of spaced radial portions which are narrowed at one end contiguous with the center. For a given number of radial portions, or switch positions, the diameter of the center is thereby made smaller than that which could be achieved by the prior art, and thereby extending the frequency range of the prior art.

7 Claims, 5 Drawing Figures

MULTIPOSITION MICROWAVE SWITCH WITH EXTENDED OPERATIONAL FREQUENCY RANGE

This is a continuation of Ser. No. 636,865 filed Aug. 2, 1984, now abandoned.

RELATED PATENTS

This is an improvement upon the invention disclosed in the U.S. Pat. No. 4,298,847 by Jerzy Hoffman, the inventor herein.

BACKGROUND OF THE INVENTION

1. Field of the Invention

This invention relates to microwave devices generally, and more particularly electromechanical multiposition coaxial switches with spaced radial channels.

2. Description of the Prior Art

In the aforementioned invention patented by this inventor, a multiposition microwave switch is taught which provides up to ten radially distributed positions at 11.5 gigahertz (ghz), with higher frequencies attainable for a lesser number of positions. While that invention was a significant advancement over the prior art, further advancement is required in order to increase the operational frequency range for microwave switches with ten or more positions.

A major problem exists, however, regarding the electrical performance of radially distributed multiposition microwave coaxial switches. As the number of positions increases, the desirable operational frequency bandwidth decreases.

This operational limitation is a mechanically created phenomenon. For any given electromagnetic transmission system geometry there exists certain definable boundary conditions which must be satisfied in order to sustain energy propagation over a designated frequency range in the generally desired transverse electromagnetic (T.E.M.) mode. For coaxial systems the primary conductor is a rectangular bar of some cross-sectional dimension (such as the reeds 68 of the aforesaid patent). Generally it will be placed in a rectangular cavity (such as the radial portions 34 of said patent, the cross-sectional dimensions of which are a function of those of the primary conductor. Similarly, a cylindrical primary conductor (inner conductor 56' of said patent) will define the dimensions of the cylindrical cavity (central portion 32 of said patent). Violation of these boundary conditions will produce a transmission system that can create and possibly sustain undesirable modes of transmission within the designated frequency range.

The aforesaid boundary problem, manifested in a multiple position switch, can best be understood by studying the cavity 30 of said patent. This cavity, which geometrically defines the transmission system, comprises an abrupt geometrical discontinuity from a cylindrical configuration at the center to radially emanating rectangular portions extending therefrom and terminating at peripheral conductive terminals or positions.

As the number of positions increases, the effect of the discontinuity becomes more pronounced because the diameter of the cylindrical center portion of the cavity becomes greater to accommodate the greater number of rectangular radial portions. When this diameter becomes large enough, undesirable T.E.M. transmission modes are established interfering with the desired transmission.

The obvious solution is to make the rectangular radial portions as narrow and as small as possible. But there are size limitations brought about by manufacturing tolerances, and more importantly, proper maintenance of sufficient mechanical integrity. For example, the reeds 68 of the aforesaid patent have minimal thickness which, in turn, determine how narrow the radial portions 34 can be.

The present invention improves significantly upon the aforesaid invention. This improvement is accomplished by a novel arrangement of features and parts, and extends the state of the art significantly as further discussed below.

SUMMARY OF THE INVENTION

In view of the foregoing factors and conditions characteristic of the prior art, it is a primary object of the present invention to provide a new and improved multiposition microwave switch having ten or more positions and operable through a frequency range out to 18 gigahertz ($10^9$ cps) with a VSWR no greater than 1.8:1.

This and other objects and advantages are achieved, in accordance with one embodiment of the present invention, by a multiposition microwave switch comprising: an essentially cylindrical metallic housing having a base and a cover plate with a cavity of uniform height disposed therein, said cavity comprising a central portion and a plurality of spaced radial portions extending radially therefrom, each said radial portion being narrowed at its end contiguous with said central portion; a central coaxial connector of predetermined characteristic impedance mounted in said base with its inner conductor extending into and coaxially with said central portion; a plurality of peripheral coaxial connectors equal in number to no more than said plurality of radial portions, each said peripheral connector having a characteristic impedance equal to that of said central connector and being mounted in said base parallel to said central connector with its inner conductor extending into a peripheral end of one of said radial portions; a plurality of radial conductors equal in number to said plurality of peripheral connectors, each switchably disposed in one of said radial portions and of a length sufficient to connect said inner conductor of said central connector to said inner conductor of said peripheral connector when in a first of two switchable positions, and biased to be grounded when in a second of said switchable positions; and actuating means, such as solenoids, disposed above said housing for selectively switching said radial conductors between said two switchable positions.

The features of the present invention which are believed to be novel are set forth with particularity in the appended claims. The present invention, both as to its organization and manner of operation, together with further objects and advantages thereof, may best be understood by making reference to the following description, taken in conjunction with the accompanying drawings in which like referenced characters refer to like elements in the several views.

DESCRIPTION OF THE PREFERRED EMBODIMENTS

Figure 1:
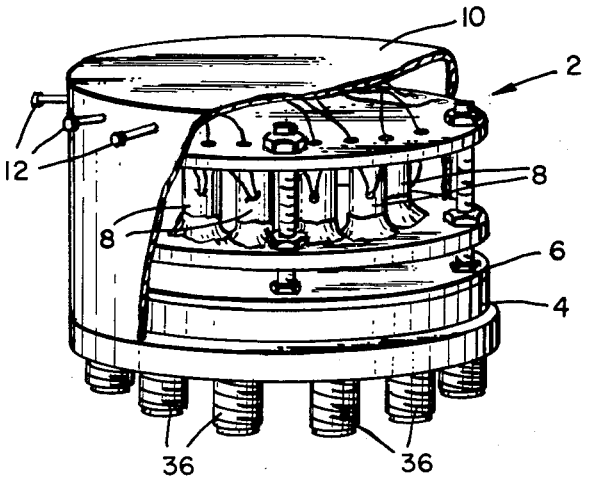
FIG. 1 is a perspective partial cross-section of a typical switch according to the invention.
Figure 4:
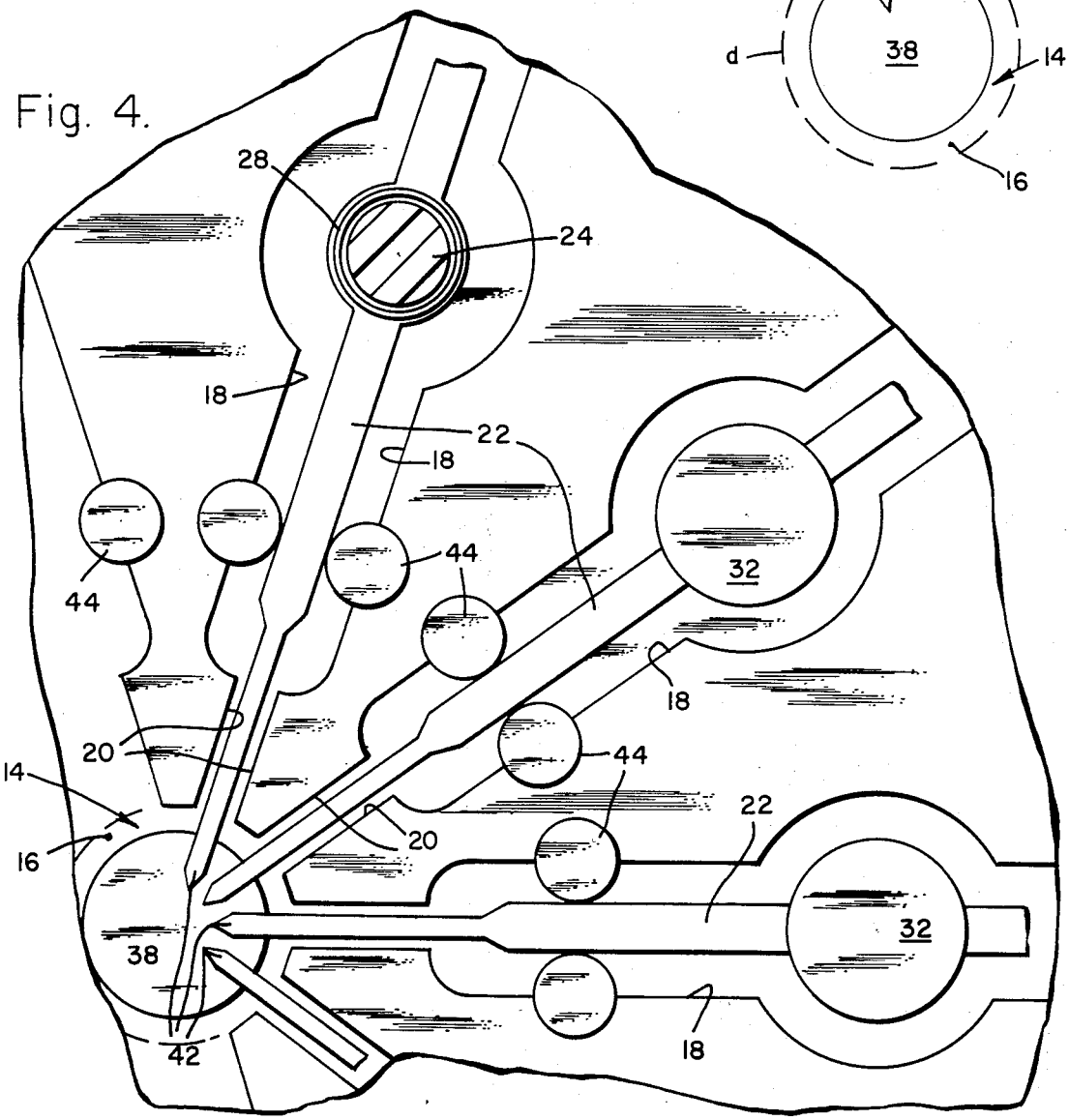
FIG. 4 is an enlarged view of a portion of FIG. 2 to more clearly show the relationship of the reeds to the cavity.

Referring now to the drawings, there is shown in FIG. 1 a multiposition coaxial microwave switch 2 comprising a base 4, a cover plate 6, solenoids 8, a cover 10, and terminals 12. Within the base 4, and covered by the plate 6, is a cavity 14, seen in plan view in FIGS. 2 and 4, and in elevation in FIG. 3. The cavity 14 comprises a central portion 16 (more clearly defined by dashed circular line 'd' in FIG. 5) and a plurality of uniformly spaced radial portions 18 extending radially therefrom. Each radial portion 18 is narrowed at its end contiguous with the central portions 16 to form a neck 20, seen clearly in FIG. 4.

Figure 2:
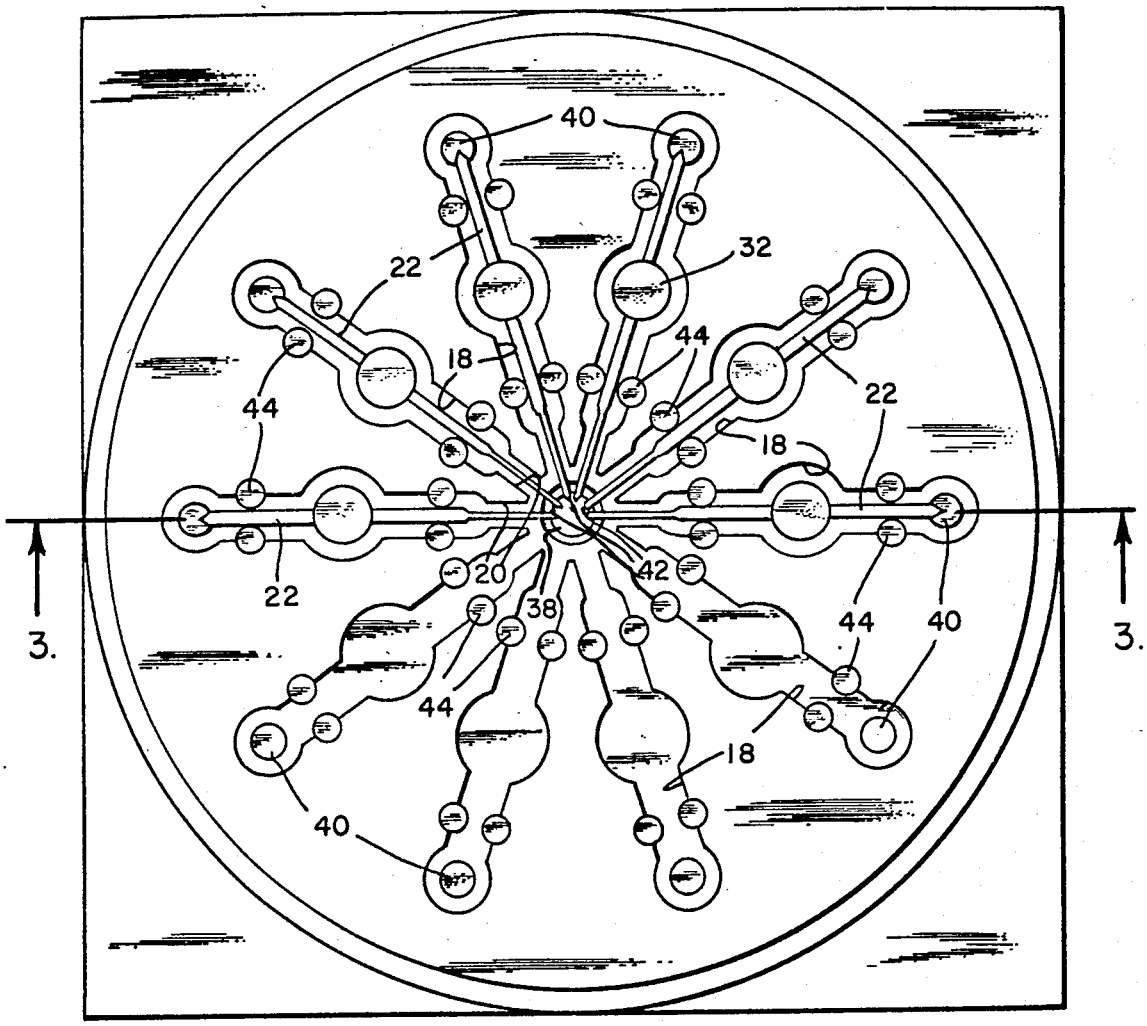
FIG. 2 is a plan view of the base of FIG. 1 with the cover plate removed showing the cavity with several conducting reeds in place.
Figure 3:
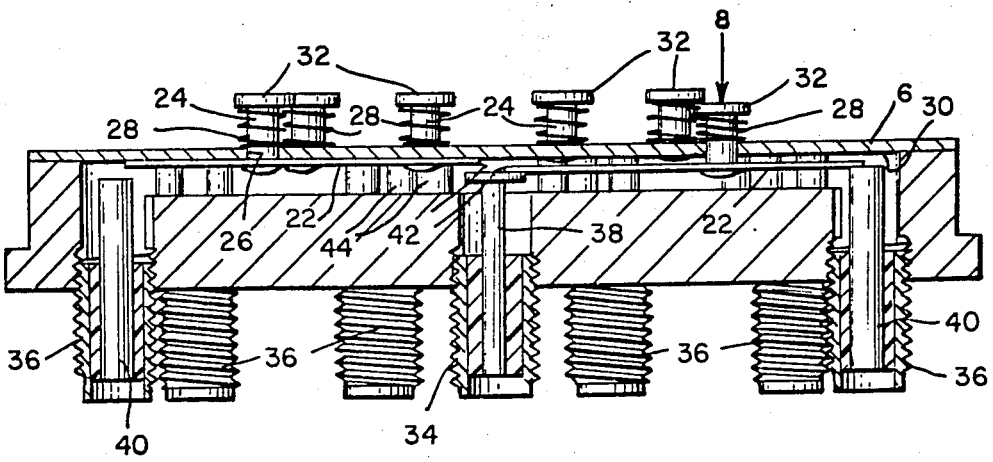
FIG. 3 is a cross-sectional view of the base and cover plate taken along section 3—3 of FIG. 2.

The formation of the cavity 14 may be accomplished by milling the base 4 according to the pattern shown in FIG. 2, forming a plurality of inwardly extending radial sections which taper, expand and taper again to define the said cavity 14. The neck 20 of the radial portion 18 may be achieved by milling away less material than was heretofore done in the prior art, thereby rendering smaller the area of the central portion 16 as well as the width of the discontinuities along the periphery thereof. This is better understood by reference to FIG. 5 wherein the current invention is compared to its prior art precursor.

Figure 5:
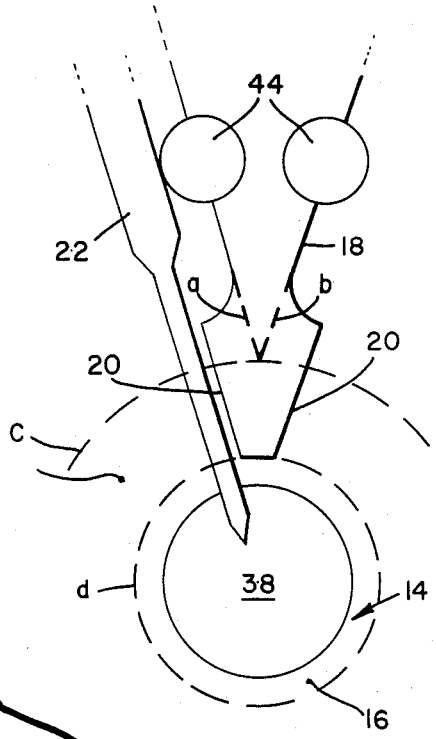
FIG. 5 is an enlarged view of a portion of FIG. 2 to show the improvement of the cavity of the current invention over that of the prior art.

Referring now to FIG. 5, the dotted lines 'a' and 'b' define the prior art pattern by which the base was milled, leaving the old central portion with a perimeter essentially defined by extending the dotted arc 'c' into a full circle. By contrast, the perimeter of the new central portion 16 of the current invention is defined by a smaller circle 'd' which is tangent to the necks 20 of the radial portions 18 there adjacent. The significance of the smaller diameter of the central portion 16 is that for the same number of radial portions 18 the cavity 14 can accommodate signals with higher frequencies than the prior art.

Referring again to FIGS. 2 and 3, there is shown a plurality of conducting reeds 22 which are mounted in rivet fashion to non-conducting posts 24. These posts 24 are disposed in holes 26 in the cover plate 6 and are spring loaded by springs 28 which bias the reeds 22 to be grounded to the cover plate 6. The reeds 22 are beneath the underside 30 of the cover plate 6 while the springs 28 are secured above the cover plate 6 by the caps 32 at the top of the posts 24.

Secured in the bottom of the base 4 is a central coaxial connector 34 and a plurality of peripheral coaxial connectors 36. The central connector 34 has a central inner conductor 38 which extends up into the central portion 16, and each peripheral connector 36 has a peripheral inner conductor 40 which extends up into the peripheral end of a radial portion 18.

Each said reed 22 extends from one peripheral inner conductor 40 to the central inner conductor 38 in order to provide an electrical conduction path therebetween when its post 24 is depressed by the downward throw of its respective solenoid 8. The reeds 22 are arranged so that their respective tips 42, which contact the central inner conductor 38 will not touch each other. This is to avoid a short circuit between reeds. Non-conductive guide posts 44 are disposed in the radial portions 18 in order to guide the reeds 22 in their vertical motion. This ensures clearance between adjacent reeds 22 as they move up and down.

Desirable performances are achieved with a typical ten-position switch according to the present invention having the following dimensions: the width of the neck 20 is essentially 0.063±0.001 inches; the radius of the central portion 16 is essentially 0.125±0.005 inches; the length of the radial portion 18 is essentially 0.823±0.005 inches; and the height of the cavity 14 is essentially 0.070±0.002 inches. Various other combinations of said dimensions may also achieve desirable results as well.

Performances achieved by ten-position switches taught by the present invention and having the aforesaid combination of dimensions are given in the following table.

TABLE OF PERFORMANCE

| Frequency Range (gHz) | Maximum VSWR | Isolation (min - Db) | Insertion Loss (max - Db) |
|---|---|---|---|
| 0–3 | 1.2:1 | 0.2 | 80 |
| 3–8 | 1.3:1 | 0.3 | 70 |
| 8–12.4 | 1.4:1 | 0.4 | 60 |
| 12.4–15.5 | 1.5:1 | 0.5 | 60 |
| 15.5–18 | 1.8:1 | 0.8 | 55 |

Variations of 5% in the aforesaid dimensions will not produce performance deteriorations of more than 5%. For greater tolerances on said dimensions, performance deteriorations are geometrically greater.

For the embodiment of the invention shown in the drawings the maximum operating current required is 140 milliamps at 28 volts DC and 72° F., and the impedance is 50 ohms.

From the foregoing it should be evident that there has been described a new and advantageous multiposition microwave switch that exhibits a relatively low maximum VSWR across a broader spectrum of microwave frequencies than has previously been achieved for the equivalent number of switch positions. Furthermore, the microwave energy propagated is substantially constrained to the generally desired transverse electromagnetic (TEM) mode of propagation by minimizing abrupt geometrical discontinuities between the central recessed cavity and the radial cavity sections.

It should also be understood that the materials and processes described in fabricating the invention are not critical, and material or processes exhibiting similar desireable characteristics and structures may be utilized. Further, it should be clear that changes, modifications and other embodiments which are obvious to persons skilled in the art to which the invention pertains are deemed to lie within the spirit, scope and contemplation of the invention.

What is claimed is:

1. A multiposition microwave switch for coupling and switching microwave energy between a central cavity and a plurality of peripherally located coaxial connectors comprising:

(a) a metallic housing having a base and a cover plate, said base having an outer periphery and a plurality of non-recessed sections which define recessed spaced inwardly extending radial cavity sections formed in said base by side walls of the non-recessed sections which side walls, progressively from said periphery, first taper, then expand and then taper again and terminate at a central recessed cavity portion defined at the periphery of the central cavity by terminations of said non-recessed sections and the space between said terminations and wherein the space between cavity sections at said last taper of said side walls forms a narrower transition region between the central cavity than the wider space between the first taper of the side walls to minimize discontinuities encountered by microwave energy propagating between the central cavity and the radial cavity sections between the first taper portion of the side walls such that the microwave energy propagated is substantially constrained to the generally desired TEM mode of propagation;

(b) a central coaxial connector of predetermined characteristic impedance mounted in said base with an inner conductor extending into and coaxially with said central recessed cavity portion;

(c) a plurality of peripheral coaxial connectors each said peripheral connector having a characteristic impedance equal to that of said central connector and being mounted in said base with an inner conductor extending into a peripheral end of one of said radial cavity sections;

(d) a plurality of radial conductors equal in number to said plurality of peripheral connectors, each switchably disposed in one of said radial cavity sections and of a length sufficient to connect said inner conductor of said central connector to said inner conductor of said peripheral connector when in a first of two switchable positions, and biased to be grounded when in a second of said switchable positions; and (e) actuating means for selectively switching said radial conductors between said two switchable positions.

2. The device claimed in claim 1 wherein the number of said radial cavity sections is ten and the side walls terminate at an end wall transverse the side walls and the width of each said end walls of said radial cavity sections is no greater than essentially 0.066 inches.

3. The device claimed in claim 2 wherein the length of each said radial cavity sections is no greater than essentially 0.87 inches.

4. The device claimed in claim 1 wherein said central cavity portion is essentially circular and has a diameter no greater than essentially 0.27 inches.

5. The device of claim 1 wherein the activating means is disposed above said housing.

6. The device of claim 1 wherein the number of peripheral coaxial connectors is equal to at least the number of radial cavity sections.

7. The device of claim 1 wherein the peripheral coaxial connectors are mounted parallel to the central connector.

* * * * *